US007490530B2

(12) United States Patent
Ishikawa et al.

(10) Patent No.: US 7,490,530 B2
(45) Date of Patent: Feb. 17, 2009

(54) HAPTIC FEEDBACK INPUT DEVICE

(75) Inventors: Shinji Ishikawa, Tokyo (JP); Takuya Maeda, Tokyo (JP); Satoshi Hayasaka, Tokyo (JP); Noriyuki Fukushima, Tokyo (JP); Ken Matsumoto, Tokyo (JP); Kaiji Nonaka, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 625 days.

(21) Appl. No.: 11/127,726

(22) Filed: May 12, 2005

(65) Prior Publication Data

US 2005/0259075 A1 Nov. 24, 2005

(30) Foreign Application Priority Data

May 18, 2004 (JP) ..... 2004-147677

(51) Int. Cl.
*G05G 9/047* (2006.01)

(52) U.S. Cl. ..... 74/471 XY; 345/161; 463/38

(58) Field of Classification Search ..... 74/471 XY, 74/473.12; 345/161; 463/38
See application file for complete search history.

(56) References Cited

U.S. PATENT DOCUMENTS

| | | | | |
|---|---|---|---|---|
| 5,142,931 | A * | 9/1992 | Menahem | 74/471 XY |
| 5,223,776 | A * | 6/1993 | Radke et al. | 318/568.1 |
| 5,271,290 | A * | 12/1993 | Fischer | 74/471 XY |
| 5,576,704 | A * | 11/1996 | Baker et al. | 341/20 |
| 5,589,828 | A * | 12/1996 | Armstrong | 341/20 |
| 5,589,854 | A * | 12/1996 | Tsai | 345/161 |
| 5,643,087 | A * | 7/1997 | Marcus et al. | 463/38 |
| 5,724,068 | A * | 3/1998 | Sanchez et al. | 345/161 |
| 5,999,168 | A * | 12/1999 | Rosenberg et al. | 345/161 |
| 6,005,551 | A * | 12/1999 | Osborne et al. | 345/161 |
| 6,036,495 | A * | 3/2000 | Marcus et al. | 434/45 |
| H1850 | H * | 6/2000 | Zimmermann | 74/471 XY |
| 6,104,382 | A * | 8/2000 | Martin et al. | 345/161 |
| 6,192,771 | B1 * | 2/2001 | Gouselis | 74/473.34 |
| 6,259,433 | B1 | 7/2001 | Meyers | |

(Continued)

FOREIGN PATENT DOCUMENTS

| | | |
|---|---|---|
| EP | 0936529 | 8/1999 |

OTHER PUBLICATIONS

Search Report dated May 4, 2007 for corresponding European Patent Application No. 05010653.3-1252 including abstract.

*Primary Examiner*—Richard W L Ridley
*Assistant Examiner*—Phillip Johnson
(74) *Attorney, Agent, or Firm*—Brinks Hofer Gilson & Lione

(57) ABSTRACT

A haptic feedback input device includes a pair of driving levers journaled at a frame such that rotary shafts thereof are perpendicular to each other, an operating lever coupled to an intersection of the two driving levers such that it can rock, and a pair of rotary motors that apply feedback force to the operating lever via the two driving levers. In the haptic feedback input device, a pair of rotary encoders detect the relative dislocation amount of the operating level, and an absolute position detecting unit is composed of swing arms fixed to the two driving levers and photo interrupters that detect the existence of blocking portions formed at the swing arms and that output ON/OFF signals. A control unit calculates a reference position of the operating lever based on ON/OFF switching signals of the photo interrupters.

7 Claims, 9 Drawing Sheets

U.S. PATENT DOCUMENTS 6,307,486 B1 * 10/2001 Takeda et al. ..... 341/20
6,373,466 B2 * 4/2002 Salcudean et al. ..... 345/161
6,429,849 B1 * 8/2002 An et al. ..... 345/161
6,531,998 B1 * 3/2003 Gordon ..... 345/156
6,536,298 B1 * 3/2003 Bellur et al. ..... 74/469
6,704,002 B1 3/2004 Martin et al.
6,854,352 B2 * 2/2005 Onodera ..... 74/471 XY
6,904,823 B2 * 6/2005 Levin et al. ..... 74/471 XY
6,909,205 B2 * 6/2005 Corcoran et al. ..... 310/12
6,948,398 B2 * 9/2005 Dybro ..... 74/471 XY
7,061,466 B1 * 6/2006 Moore et al. ..... 345/156
7,138,981 B2 * 11/2006 Kim et al. ..... 345/161
2002/0033841 A1 3/2002 Rosenberg
2003/0201975 A1 * 10/2003 Bailey et al. ..... 345/161
2005/0073496 A1 * 4/2005 Moore et al. ..... 345/156
2005/0162389 A1 * 7/2005 Obermeyer et al. ..... 345/161
2005/0252329 A1 * 11/2005 Demers ..... 74/471 XY

* cited by examiner

HAPTIC FEEDBACK INPUT DEVICE

This application claims the benefit of priority to Japanese Patent Application No. 2004-147677 filed on May 18, 2004, herein incorporated by reference.

BACKGROUND OF THE INVENTION

1. Field of the Invention

The present invention relates to a haptic feedback input device that provides electrically controlled haptic to an operating member operated by hand, and more particularly, to an absolute position detecting unit that detects a reference position of the operating member.

2. Description of the Related Art

In recent years, various haptic feedback input devices having a force feedback function have been proposed, which integrates the control functions of each controller for a car air conditioner, a car audio, a car navigation system, etc., and supplies feedback force, such as resistance force or thrusting force, to an operating member according to the operating amount or the operating direction of the operating member when a device to be controlled is selected or a function is adjusted by the operating member operated by hand, which provides satisfactory operation feeling and improves the operability of the operating member. In the related art, for example, there has been known a haptic feedback input device including an operating lever, acting as an operating member, free to move; a converting portion that converts the rocking movement of the operating lever into the swinging motions of a pair of driving levers perpendicular to each other; a pair of rotary encoders that detect the swinging amount and the swinging direction of the two driving levers; and a pair of rotary motors that supply feedback force to the operating lever. This device drives the two rotary motors based on output signals from the two rotary encoders to supply desired feedback force to the operating lever via the two driving levers (for example, see Japanese Unexamined Patent Application Publication No. 2003-22159 (pages 5 to 7 and FIG. 1)).

FIG. 10 is a plan view showing the internal structure of the haptic feedback input device disclosed in Patent Document 1. As shown in FIG. 10, a base 100 has first and second rotary motors 101 and 102, and first and second rotary encoders 103 and 104 respectively coupled with rotary shafts of the rotary motors 101 and 102 mounted thereon. The rotary shaft of the first rotary motor 101 is perpendicular to the rotary shaft of the second rotary motor 102, and the first and second rotary encoders 103 and 104 are disposed in the vicinity of an intersection P between the rotary shafts of the two rotary motors 101 and 102. In addition, first and second driving levers 105 and 106 are supported on the base 100 such that they can swing, and an operating lever 108 is coupled with the driving levers 105 and 106 via a driving body 107. The first driving lever 105 can swing around a shaft 105*a* parallel to the rotary shaft of the first rotary motor 101, and the front end of the first driving lever 105 is formed with a gear portion 105*b* engaging with a gear 109 fixed to the rotary shaft of the first rotary motor 101. The second driving lever 106 can swing around a shaft 106*a* parallel to the rotary shaft of the second rotary motor 102, and the front end of the second driving lever 106 is formed with a gear portion 106*b* engaging with a gear 110 fixed to the rotary shaft of the second rotary motor 102. In addition, the first and second rotary motors 101 and 102 and the first and second rotary encoders 103 and 104 are connected with a control unit, which is not shown in FIG. 10, and the control unit acquires the output signals from the first and second rotary encoders 103 and 104 and outputs desired control signals to the first and second rotary motors 101 and 102.

In the haptic feedback input device having the above-mentioned schematic structure, when an operator moves the operating lever 108 in a certain direction, for example, the Y-Y direction in FIG. 10, the first driving lever 105 swings around the shaft 105*a*, accordingly the gear 109 and the first rotary encoder 103 are rotated. When the operating lever 108 is moved in the X-X direction, the second driving lever 106 swings around the shaft 106*a*, accordingly the gear 110 and the second rotary encoder 104 are rotated. Also, when the operating lever 108 is moved in a direction between the X and Y directions, the first and second driving levers 105 and 106 swing respectively, and the first and second rotary encoders are rotated. The control unit acquires the output signals from the rotary encoders 103 and 104, and computes the swinging direction and the swinging amount of the first and second driving levers 105 and 106, that is, the moving direction and the moving amount (moving angle) of the operating lever 108, based on the output signals. Then, the control unit outputs control signals to the first and second rotary motors 101 and 102 based on the computed results. Therefore, desired operation feeling is supplied to the operating lever 108. For example, in a case in which the operating lever 108 is moved in a certain direction at a certain angle, if the first and second rotary motors 101 and 102 are rotated in an opposite direction to the rotary motion of the first and second driving levers 105 and 106, a certain degree of operation force is supplied to the operating lever 108, and the operator operating the operating lever 108 by hand can feel this operation force as a click sense.

In the haptic feedback input device in the related art, the control unit computes the moving direction and the moving amount of the operating lever based on the output signals from the rotary encoders. However, since the rotary encoder outputs two kinds of pulse signals having a phase difference of 90 degrees, the relative displacement amount of the operating lever cannot be detected by using only the output signals of the rotary encoders. Thus, an absolute position detecting unit is required to detect an absolute angle with respect to the reference position of the operating lever.

In the related art, there has been known a technique in which a potentiometer (variable resistor) is used as such an absolute position detecting unit, and the absolute position of the operating lever is computed based on a variation in resistance by operating the potentiometer according to the movement of the operating lever. However, the potentiometer has a problem of durability in that the resistance value easily varies due to abrasion caused by the sliding motion of a brush or the accumulation of abrasion powder with the elapse of time and a detection accuracy problem in that characteristics of a resistor vary easily according to manufacturing conditions.

SUMMARY OF THE INVENTION

The invention has been made to solve the above problems, and an object of the invention is to provide a haptic feedback input device including an absolute position detecting unit having a simple structure and high durability and detection accuracy.

In order to achieve the above object, according to an aspect of the invention, a haptic feedback input device includes an operating member that is manually operated by an operator; a base that supports the operating member free to move; a relative position detecting unit that detects the moving amount of the operating member; an absolute position detecting unit that detects a reference position of the operating member; actuators that apply feedback force to the operating member; and a control unit that controls the actuator based on output signals from the relative position detecting unit and the absolute position detecting unit. In this device, the absolute position detecting unit is composed of detection targets that move in conjunction with the operating member and detecting elements that detect the existence of the detection targets, respectively, and that output ON/OFF signals. In addition, the control unit computes the reference position of the operating member based on the change of the output of the detection element.

In the haptic feedback input device constructed as above, when an operator operates the operating member by hand, the detecting element detects the existence of the detection target moving in conjunction with the operating member. However, the detecting element outputs the ON/OFF switching signals only when the detection target passes a certain spot in the moving range of the detection target. Thus, the control unit can determine the reference position of the operating member based on whether the output of the detecting element is '0' or '1', and can calculates the operating amount of the operating member based on the reference position and the output signals from the relative position detecting unit. Therefore, it is possible to compute the moving amount of the operating member using the absolute position detecting unit having a simple structure and to improve the durability and detection accuracy of the absolute position detecting unit.

In the above construction, it is preferable that the detection target occupies one side of a detecting area in which the detection target can move, and that the control unit control the actuator to be rotated clockwise or counterclockwise until the change of output occurs in the detecting element when a system is started. Therefore, it is not required to provide another driving source to calculate the reference position.

In this case, it is preferable that the control unit control the actuator to be driven in a direction where the detection target is not detected when the detecting element detects the detection target at the time when the system is started, and that the control unit control the actuator to be driven in a direction where the detection target is detected when the detecting element does not detect the detection target. In this way, the reference position of the operating member can be calculated in a short time when the system is started. In addition, it is preferable that the control unit stop driving the actuator when the detection target reaches a location where the variation of output occurs in the detecting element and initialize the location as the reference position of the operating member. In this way, the operating member can automatically return to its initial position in a short time when the system is started.

Although a slide-type or rotary-type operating member can be used in the above construction, it is preferable that the operating member be composed of an operating lever free to move and a pair of driving levers swinging in conjunction with the movement of the operating lever such that rotary shafts thereof are perpendicular to each other. Further, it is preferable that the actuators be a pair of rotary motors that apply feedback force to the operating member via the two driving levers, respectively.

In a joystick-type haptic feedback input device described above, it is preferable that the detection targets be swing arms that integrally swing with the driving levers, that the detecting elements be photo interrupters provided in the swinging ranges of the swing arms, and that the relative position detecting unit be a rotary encoder. With the above components, the overall structure of a detecting unit including the absolute position detecting unit and the relative position detecting unit can be simplified.

Further, in the above configuration, at the time when the system is started, if the photo interrupters output the ON/OFF switching signals when the swing arm passes a central location of its swinging range, the operating lever automatically returns to its neutral position. Therefore, the operator can operate the operating lever right after the system is started.

DESCRIPTION OF THE PREFERRED EMBODIMENT

Figure 1:
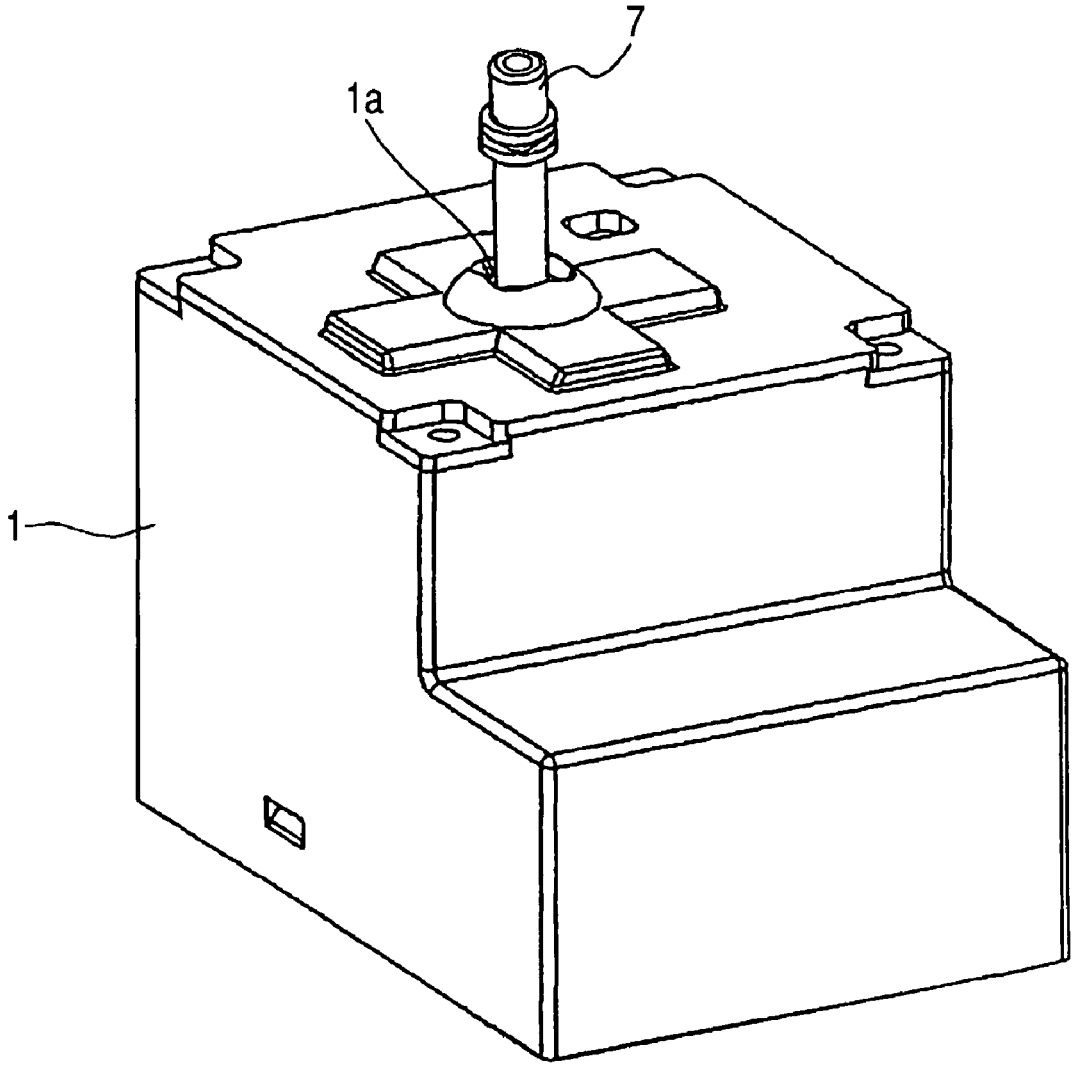
FIG. 1 is a perspective view of a haptic feedback input device according to an embodiment of the present invention.
Figure 2:
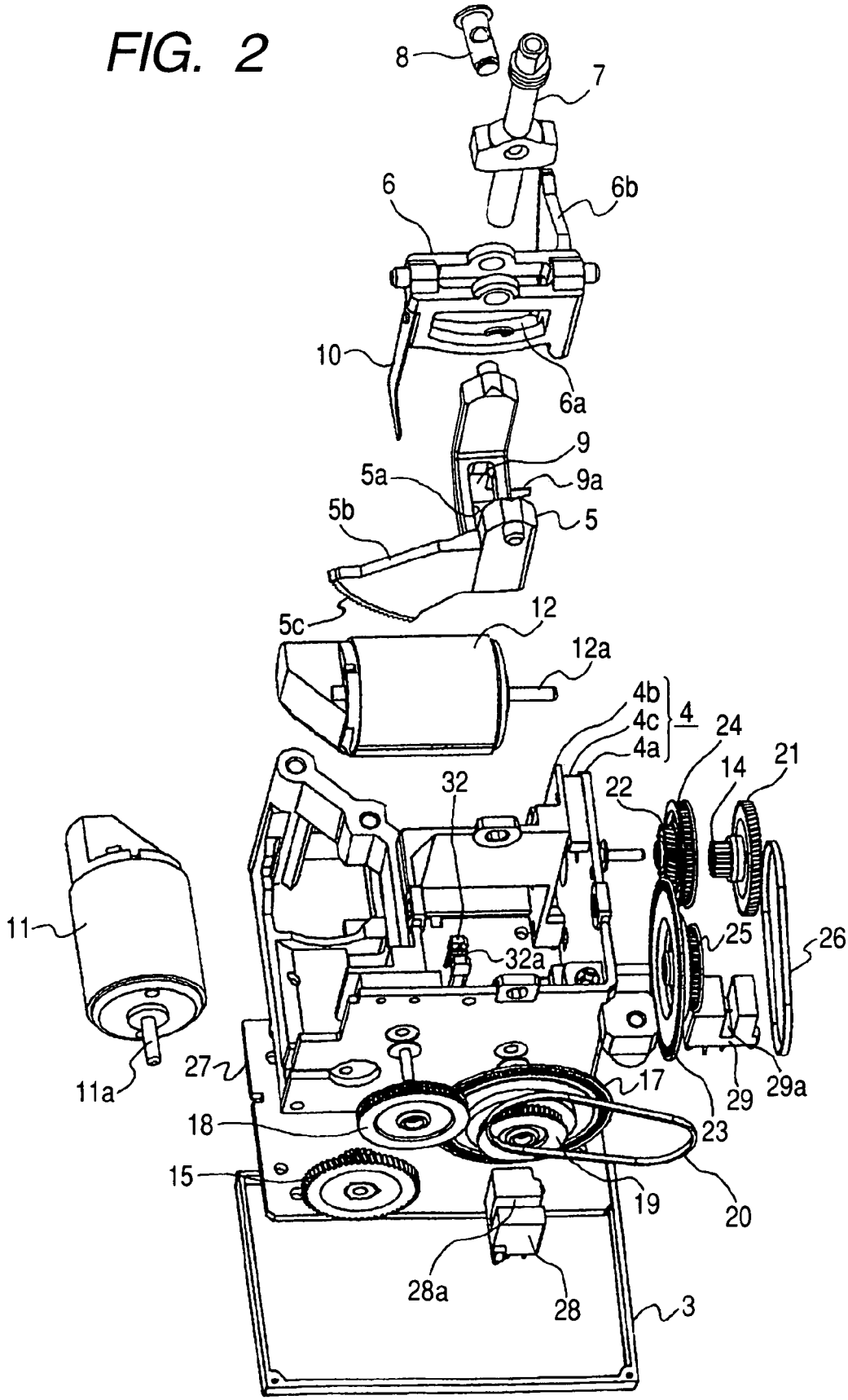
FIG. 2 is an exploded perspective view of a stick controller.
Figure 3:
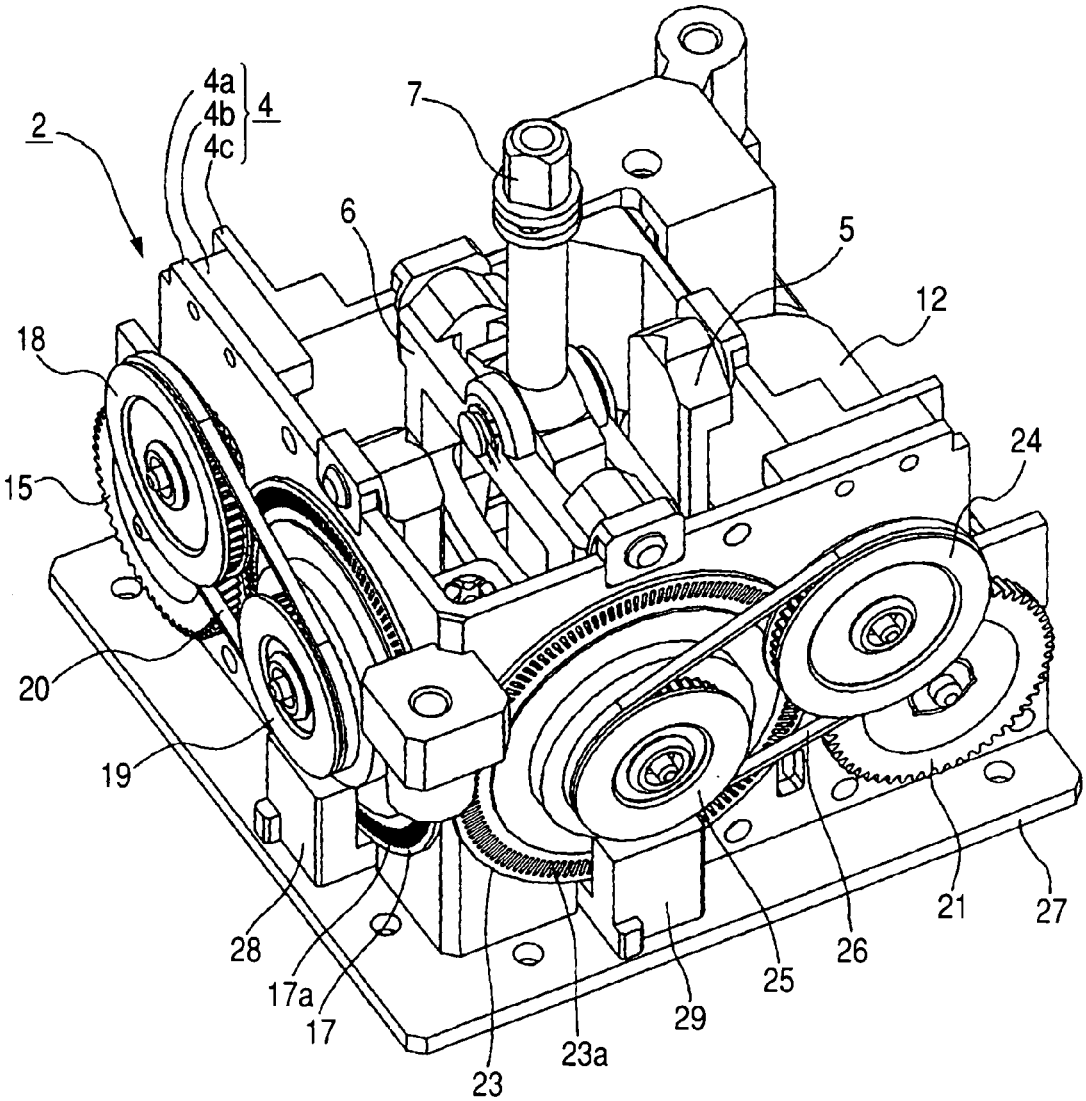
FIG. 3 is a perspective view of the stick controller.
Figure 4:
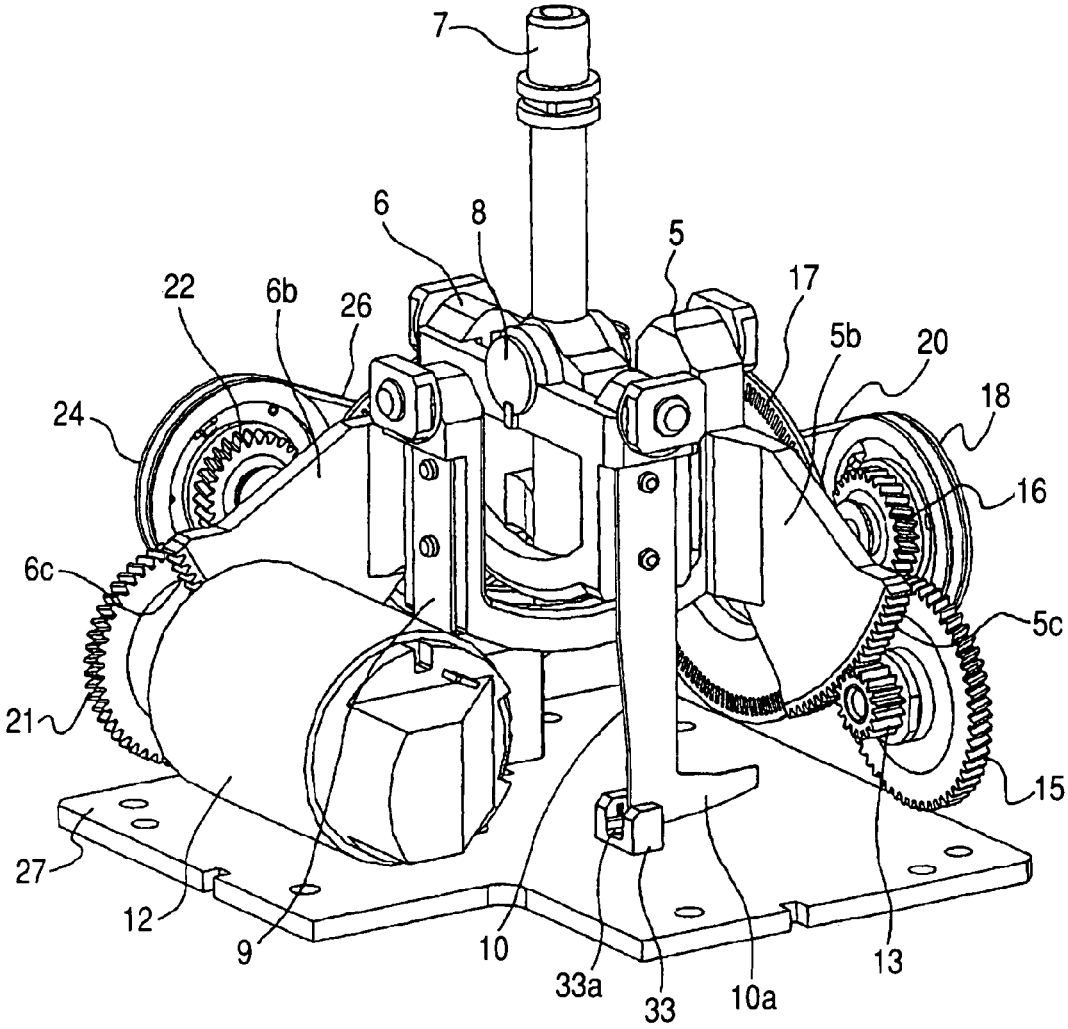
FIG. 4 is a perspective view of a power conversion mechanism.
Figure 5:
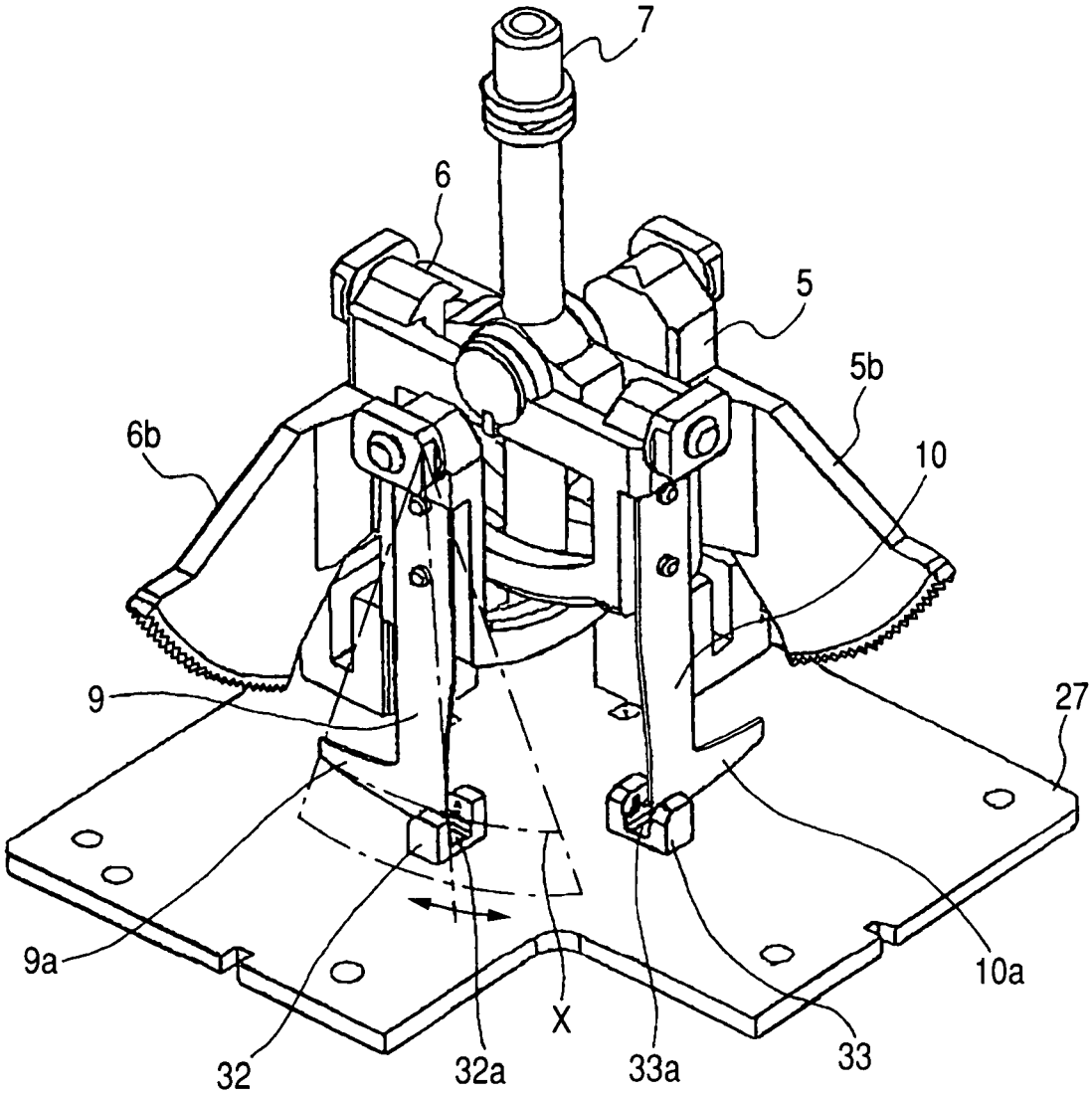
FIG. 5 is a perspective view of an absolute position detecting unit.
Figure 6:
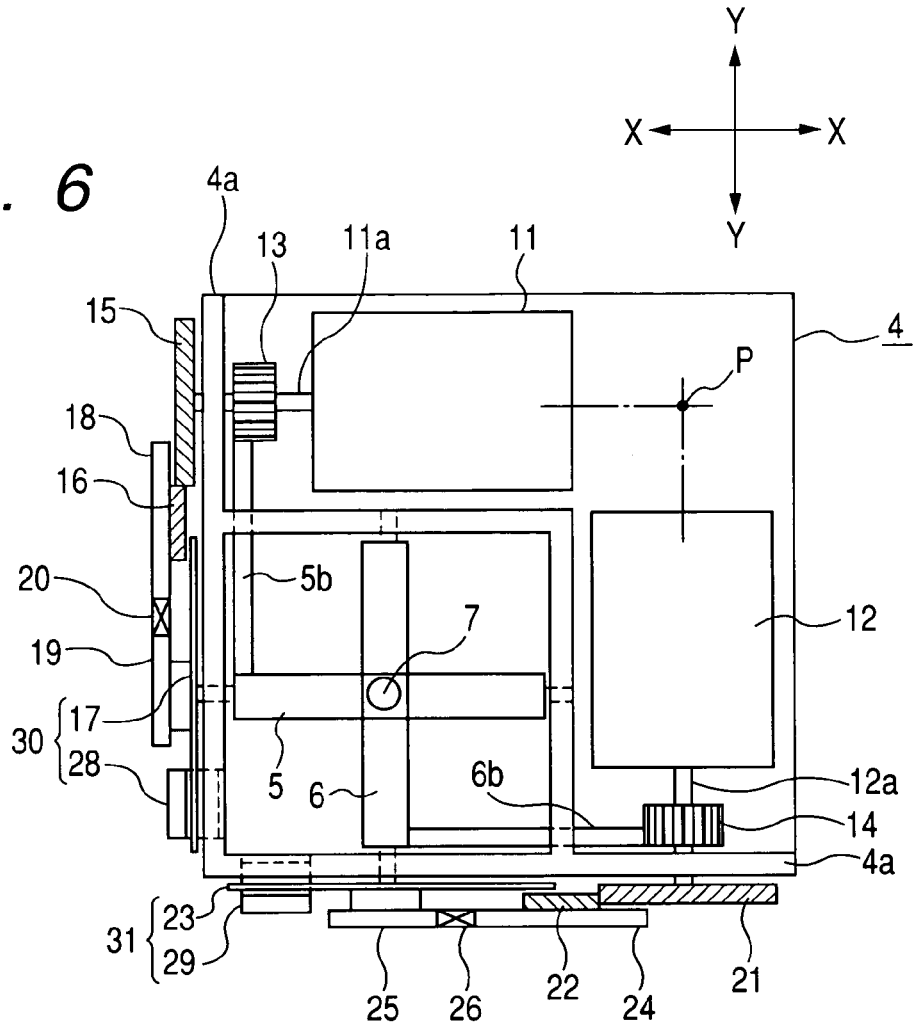
FIG. 6 is a plan view illustrating the layout of parts constituting the joystick controller.
Figure 7:
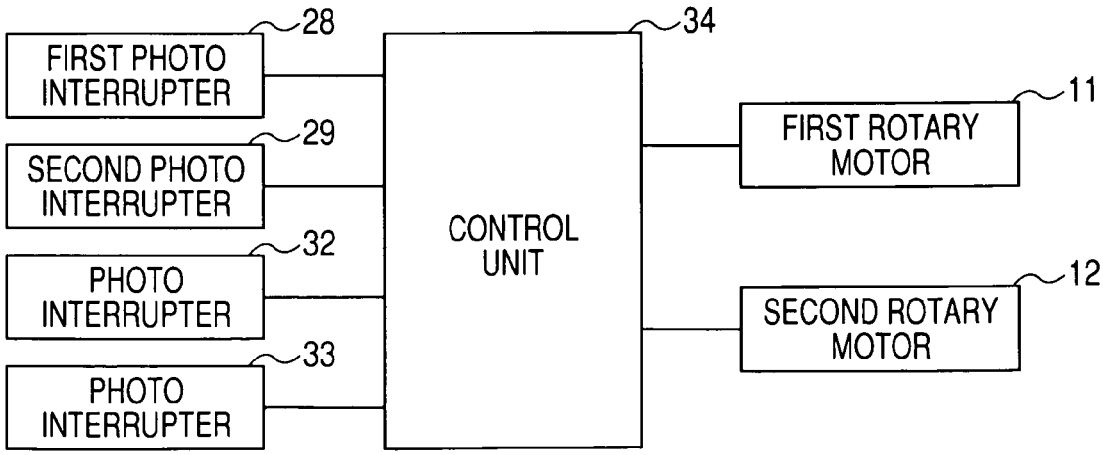
FIG. 7 is a block diagram of a control unit.
Figure 8:
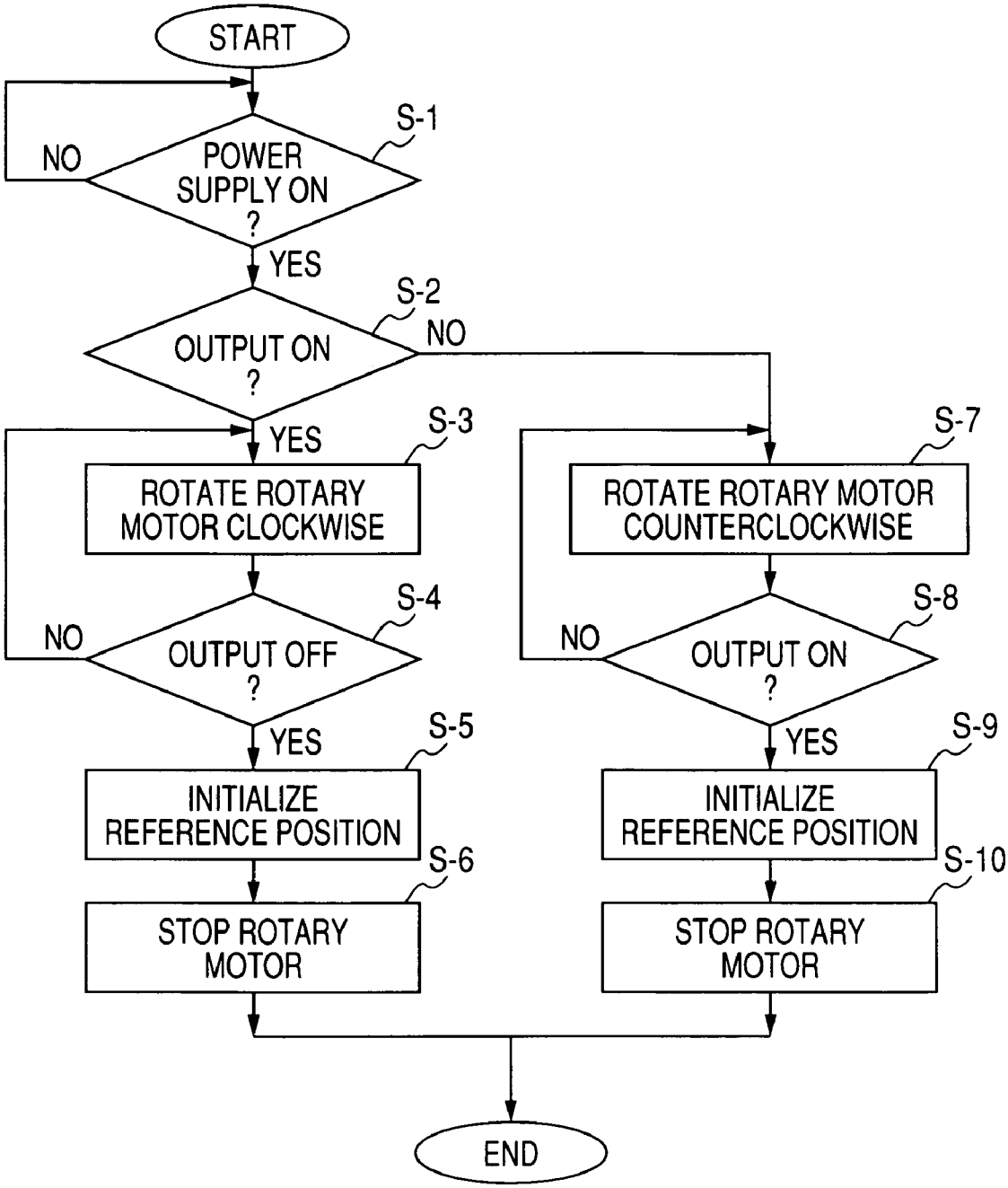
FIG. 8 is a flow chart illustrating an initializing operation sequence of the control unit.

Hereinafter, an embodiment of the invention will be described with reference to the accompanying drawings. FIG. 1 is a perspective view of a haptic feedback input device according to an embodiment of the invention, and FIG. 2 is an exploded perspective view of a stick controller. FIG. 3 is a perspective view of the stick controller, and FIG. 4 is a perspective view of a power conversion mechanism. FIG. 5 is a perspective view of an absolute position detecting unit, and FIG. 6 is a plan view illustrating the layout of parts constituting the stick controller. FIG. 7 is a block diagram of a control unit, and FIG. 8 is a flow chart illustrating an initializing operation sequence of the control unit.

As shown in FIGS. 1 to 5, the haptic feedback input device according to this embodiment includes a synthetic resin chassis 1 having a hole 1*a* on its top surface, a stick controller 2 encased in the chassis 1, and a cover body that closes a lower opening of the chassis 1. The chassis 1 can be properly provided at a place, such as a vehicle center console.

The stick controller 2 includes a box-shaped frame (base) 4, and the frame 4 is formed by integrating a first supporting body 4*a* having an L shape in plan view with a second supporting body 4*b* having a reversed L shape in plan view, with a spacer 4*c* interposed between them. The first supporting body 4*a* and the second supporting body 4*b* are made of a material having a high mechanical strength, such as aluminum, and in the frame 4, a supporting portions having a rectangular shape in plan view is formed along each wall of the first and second supporting bodies 4*a* and 4*b*. In the supporting portion, first and second driving levers 5 and 6 are disposed such that their rotary shafts are orthogonal to each other, and both ends of the first driving lever 5 are journaled at two walls of the supporting portion opposite to each other, and both ends of the upper portion of the second driving lever 6 are journaled at the other two walls of the supporting portion opposite to each other. An operating lever 7 is coupled with the intersection of the first and second driving levers 5 and 6, and passes through the hole 1*a* to protrude outwards from the chassis 1. The first and second driving levers 5 and 6 constitute a power conversion mechanism that converts the swinging movement of the operating lever 7 into two swinging motions perpendicular to each other, and an intermediate portion of the operating lever 7 is journaled at an intermediate portion of the upper portion of the second driving lever 6 with a pin 8. The operating lever 7 passes through a long hole 6*a* formed at the lower portion of the second driving lever 6, and is inserted into a long hole 5*a* formed at the lower portion of the first driving lever 5. Therefore, when the operating lever 7 is moved in a certain direction, the first and second driving levers 5 and 6 swing in accordance with the moving direction.

A fan-shaped gear portion 5*b* is integrally formed at one side of the first driving lever 5, and a teeth portion 5*c* extending circularly around the swinging shaft is formed at the front end of the gear portion 5*b*. In addition, a first swing arm 9 is fixed to the other side of the first driving lever 5, and a blocking portion 9*a* formed at the lower end of the first swing arm 9 protrudes in the opposite direction of the gear portion 5*b*. Similarly, a fan-shaped gear portion 6*b* is formed at one side of the second driving lever 6, and a teeth portion 6*c* extending circularly around the swinging shaft is formed at the front end of the gear portion 6*b*. In addition, a second swing arm 10 is fixed to the other side of the second driving lever 6, and a blocking portion 10*a* formed at the lower end of the second swing arm 10 protrudes in the opposite direction of the gear portion 6*b*.

First and second rotary motors 11 and 12 are mounted on the second supporting body 4*b* of the frame 4, as shown in FIG. 6, such that rotary shafts 11*a* and 12*a* thereof are orthogonal to each other. If the intersection at which both extension lines of the rotary shafts 11*a* and 12*a* of the rotary motors 11 and 12 intersect each other at right angles is indicated by a point P, the rotary shaft 11*a* of the first rotary motor 11 protrudes in the opposite direction of the intersection P, and the rotary shaft 12*a* of the second rotary motor 12 also protrudes in the opposite direction of the intersection P. A gear 13 is fixed to the rotary shaft 11*a* of the first rotary motor 11, and is engaged with the teeth portion 5*c* of the gear portion 5*b* formed in the first driving lever 5 at the inside of the first supporting body 4*a*. Although the first rotary motor 11 is not illustrated in FIG. 4 for the sake of the convenience of explanation, the gear 13 fixed to the rotary shaft 11*a* and the gear portion 5*b* integrated with the first driving lever 5 constitute a deceleration gear series, as viewed from the first rotary motor 11. The rotation of the first rotary motor 11 is decelerated by the deceleration gear series and is then transmitted to the first driving lever 5. Similarly, a gear 14 is fixed to the rotary shaft 12*a* of the second rotary motor 12, and is engaged with the teeth portion 6*c* of the gear portion 6*b* formed in the second driving lever 6 at the inside of the first supporting body 4*a*. The gear 14 and the gear portion 6*b* constitute a deceleration gear series, as viewed from the second rotary motor 12, and the rotation of the second rotary motor 12 is decelerated by the deceleration gear series and is then transmitted to the second driving lever 6.

In addition, a large-diameter spiral gear 15 is fixed to the rotary shaft 11*a* of the first rotary motor 11, and is integrated with the gear 13. The large-diameter spiral gear 15 protrudes from the wall of the first supporting body 4*a* to the outside, and a small-diameter gear 16 and a first code plate 17 are journaled at this wall such that they can rotate. Both the spiral gears 15 and 16 are engaged with each other, and an endless belt 20 is wound between a pulley 18 integrated with the small-diameter gear 16 at the outside of the small-diameter gear 16 and a pulley 19 integrated with the first code plate 17 at the outside of the first code plate 17. The gear 13, the large-diameter spiral gear 15, the small-diameter spiral gear 16, the pulley 18, the belt 20, and the pulley 19 constitute an acceleration gear series, as viewed from the first driving lever 5, and the rotation of the first driving lever 5 is accelerated by the acceleration gear series and is then transmitted to the first code plate 17. Similarly, a large-diameter spiral gear 21 is fixed to the rotary shaft 12*a* of the second rotary motor 12, and is integrated with the gear 14. The large-diameter spiral gear 21 protrudes from the wall of the first supporting body 4*a* to the outside, and a small-diameter gear 22 and a second code plate 23 are journaled at this wall such that they can rotate. Both the spiral gears 21 and 22 are engaged with each other, and an endless belt 26 is wound between a pulley 24 integrated with the small-diameter gear 22 at the outside of the small-diameter gear 22 and a pulley 25 integrated with the second code plate 23 at the outside of the second code plate 23. The gear 14, the large-diameter spiral gear 21, the small-diameter spiral gear 22, the pulley 24, the belt 26, and the pulley 25 constitute an acceleration gear series, as viewed from the second driving lever 6, and the rotation of the second driving lever 6 is accelerated by the acceleration gear series and is then transmitted to the second code plate 23.

A circuit substrate 27 is attached to the lower end of the frame 4, and first and second photo interrupters 28 and 29 are mounted on the circuit substrate 27. Although not shown, both the photo interrupters 28 and 29 each have an LED (light emitting element) and a phototransistor (light receiving element), and the LEDs and the phototransistors are opposite to each other with recessed portions 28*a* and 29*a* interposed between them, respectively. The outer circumferential portions of the first and second code plates 17 and 23 rotate in the recessed portions 28*a* and 29*a* of the first and second photo interrupters 28 and 29, respectively, and a number of slits 17*a* and 23*a* are formed in the outer circumferential portions of the first and second code plates 17 and 23. Also, the first photo interrupter 28 and the first code plate 17 constitute a first rotary encoder 30, and the second photo interrupter 29 and the second code plate 23 constitute a second rotary encoder 31. In addition, the first and second rotary encoders 30 and 31 detect the relative displacement amount of the operating lever 7. That is, when the first and second driving levers 5 and 6 swing in accordance with the swinging movement of the operating lever 7, the swinging motion is transmitted to the first and second code plates 17 and 23 via the acceleration gear series, and the photo interrupters 28 and 29 of the first and second rotary encoders 30 and 31 respectively output two kinds of pulse signals (A-phase signal and B-phase signal) having a phase difference of 90 degrees. Therefore, the relative swinging amounts and the relative swinging directions of the first and second driving levers 5 and 6, that is, the moving direction and the swinging amount (swing angle) of the operating lever 7 can be detected based on the output signals.

As shown in FIG. 5, another pair of photo interrupters 32 and 33 other than the first and second photo interrupters 28 and 29 are mounted on the circuit substrate 27, and the photo interrupters 32 and 33 each have a LED (light emitting element) and a phototransistor (light receiving element) facing each other with a recessed portion 32*a* or 33*a* interposed between them. The blocking portion 9*a* of the first swing arm 9 passes through the recessed portion 32*a* of the photo interrupter 32 in accordance with the swinging of the first driving lever 5, and the first swing arm 9 and the photo interrupter 32 constitute a first absolute position detecting unit. Also, the blocking portion 10*a* of the second swing arm 10 passes through the recessed portion 33*a* of the photo interrupter 33 in accordance with the swinging of the second driving lever 6, and the second swing arm 10 and the photo interrupter 33 constitute a second absolute position detecting unit. In this case, the blocking portions 9*a* and 10*a* of the first and second swing arms 9 and 10 occupy half of detecting areas X and Y (the area Y is not shown) in which the first and second swing arms 9 and 10 can swing. For example, when the first and second swing arms 9 and 10 swing as much as 30 degrees from their neutral positions in either direction (therefore, total 60 degrees), the blocking portions 9*a* and 10*a* protrude as much as 30 degrees in one direction from the neutral positions of the first and second swing arms 9 and 10. Therefore, when the operating lever 7 stands on its neutral position, the blocking portions 9*a* and 10*a* protrude outwards as much as half of the swing angle of the first and second swing arms 9 and 10 from the centers of the recessed portions 32*a* and 33*a*, and the outputs of the photo interrupters 32 and 33 are changed at the that positions. Therefore, in a case in which the operating lever 7 is moved in a certain direction from its neutral position and the first and second driving levers 5 and 6 swing accordingly, if the blocking portions 9*a* and 10*a* move to pass through the recessed portions 32*a* and 33*a*, light emitted from the LEDs is blocked by the blocking portions 9*a* and 10*a*, so that OFF signals are output from the photo interrupters 32 and 33. However, if the blocking portions 9*a* and 10*a* move away from the recessed portions 32*a* and 33*a*, the phototransistors 32 and 33 receive the light emitted from the LEDs, and the photo interrupters 32 and 33 output ON signals. In the present embodiment, although the blocking portion occupies half of the detecting area, the blocking portion does not necessarily occupy the half of the detecting area and may occupy one side of the detecting area to function as an absolute position detecting unit.

As shown in FIG. 7, the respective photo interrupters 28, 29, 32, and 33, and the first and second rotary motors 11 and 12 are connected with the control unit 34, and the control unit 34 has a CPU and a memory therein. The CPU acquires output signals from the respective photo interrupters 28, 29, 32, and 33, and calculates an absolute position based on the detected signals of the photo interrupters 32 and 33. Then, the CPU computes the swinging direction or swinging amount of the first and second driving levers 5 and 6, that is, the swinging direction and the swinging amount (swing angle) of the operating lever 7 from the detected signals of the first and second photo interrupters 28 and 29, based on the absolute position. In addition, the control unit 34 determines a control signal based on data or programs stored in the memory, and outputs the control signal to the first and second rotary motors 11 and 12. The control signal is a signal corresponding to an operation feeling supplied to the operating lever 7, which generates vibrations or changes actuation force (resistance or thrusting force) etc. Meanwhile, circuit-constituting parts of the control unit 34 are mounted on the rear surface or of the circuit substrate 27, which is not shown in the drawing, or on another circuit substrate.

Next, the operation of the haptic feedback input device constructed as described above will be described with reference to the flowchart shown in FIG. 8.

The operating lever still stands at a location where the operating lever stood when the power supply was switched OFF right before while the system of the haptic feedback input device is not in operation, that is, the ignition switch is not turned on and thus the power supply is not in an ON state. As shown in FIG. 8, when the power supply is switched ON (S-1) in this state to ignite the system, first, the control unit 34 determines the types of signals output from the photo interrupters 32 and 33 of the first and second absolute position detecting units (S-2). In step (S-2), if the output signals of the photo interrupters 32 and 33 are ON, that is, if the blocking portions 9*a* and 10*a* of the first and second swing arms 9 and 10 are located away from the recessed portions 32*a* and 33*a* and the phototransistors receive the light emitted from the LEDs, the process proceeds to step (S-3), and then the control unit 34 rotates the first and second rotary motors 11 and 12 in a certain direction (for example, in the clockwise direction). Then, the first and second driving levers 5 and 6 begin to swing to the neutral positions, and the blocking portions 9*a* and 10*a* move closer to the recessed portions 32*a* and 33*a*. When the blocking portions 9*a* and 10*a* enter the recessed portions 32*a* and 33*a* and the output signals of the photo interrupters 32 and 33 are switched from ON to OFF, the process proceeds to step (S-5) from step (S-4). Subsequently, the control unit 34 determines the present position of the operating lever as a reference position and initializes the system, and then the process proceeds to step (S-6), and then the first and second rotary motors 11 and 12 stop.

On the other hand, in step (S-2), if the output signals of the photo interrupters 32 and 33 are OFF, that is, if the blocking portions 9*a* and 10*a* of the first and second swing arms 9 and 10 are located in the recessed portions 32*a* and 33*a* and the light emitted from the LED is blocked by the blocking portions 9*a* and 10*a* and is not incident on the phototransistors, the process proceeds to step (S-7) in which the control unit 34 rotates the first and second rotary motors 11 and 12 counterclockwise. Then, the first and second driving levers 5 and 6 begin to swing to the neutral positions, and the blocking portions 9*a* and 10*a* move away from the recessed portions 32*a* and 33*a*. When the blocking portions 9*a* and 10*a* pass through the recessed portions 32*a* and 33*a* and the output signals of the photo interrupters 32 and 33 are switched from OFF to ON, the process proceeds to step (S-9) from step (S-8), and the control unit 34 determines the present position of the operating lever as a reference position and initializes the system. After that, the process proceeds to step (S-10) in which the first and second rotary motors 11 and 12 stop.

Therefore, when the system is started, the operating lever 7 automatically returns to the neutral position irrespective of the previous state, and the operator can move the operating lever 7 standing at the neutral position in a certain direction to select a device to be controlled or to adjust its function. When the operator moves a joystick in a certain direction from the neutral position, the first and second driving levers 5 and 6 respectively swing around their swinging shafts in accordance with the moving direction of the operating lever 7. For example, when the operating lever 7 is moved in the Y-Y direction in FIG. 6, only the first driving lever 5 swings in the Y-Y direction. In addition, when the operating lever 7 is moved in the X-X direction, only the second driving lever 6 swings in the X-X direction. When the operating lever 7 is moved in the X-Y direction (a direction between the X direction and the Y direction), the first and second driving levers 5 and 6 swing together. In this case, the swinging motion of the first driving lever 5 is accelerated by the gear 13, the large-diameter spiral gear 15, the small-diameter spiral gear 16, the pulley 18, the belt 20, and the pulley 19, and is transmitted to the first code plate 17 from the teeth portion 5*c* of the gear portion 5*b*, and the swinging motion of the second driving lever 6 is accelerated by the gear 14, the large-diameter spiral gear 21, the small-diameter spiral gear 22, the pulley 24, the belt 26, and the pulley 25, and is transmitted to the second code plate 23 from the teeth portion 6*c* of the gear portion 6*b*. Thus, the photo interrupters 28 and 29 of the first and second rotary encoders 30 and 31 output two types of pulse signals having a phase difference of 90 degrees, respectively, and the pulse signals are input to the control unit 34 as relative position information.

The control unit 34 computes the swinging direction and the swinging amount of the first and second driving levers 5 and 6, based on the relative position calculated from the respective photo interrupters 28 and 29 of the first and second rotary encoders 30 and 31 and the absolute position calculated from the ON/OFF signals of the photo interrupters 32 and 33, and outputs predetermined control signals to the first and second rotary motors 11 and 12. For example, when the operating lever 7 is moved in a certain direction by a certain amount, the rotary motions of the first and second rotary motors 11 and 12 are decelerated by the gears 13 and 14 and the gear portions 5*b* and 6*b*, and are transmitted to the first and second driving levers 5 and 6, respectively. Then, when actuation force that resists the movement of the operating lever 7 is applied to the operating lever 7 via the first and second driving levers 5 and 6, the operator operating the operating lever 7 by hand can feel this actuation force as a click sense.

As described above, in this embodiment, the haptic feedback input device includes the operating lever 7 manually operated by an operator; the first and second driving levers 5 and 6 that can swing in conjunction with the movement of the operating lever 7 and whose swinging shafts are perpendicular to each other; the first and second rotary encoders 30 and 31 that detect the swinging motions of the first and second driving levers 5 and 6; the first and second rotary motors 11 and 12 that supply feedback force to the operating lever 7 via the first and second driving levers 5 and 6; and the control unit 34 that controls the first and second rotary motors 11 and 12 based on detection signals outputted from the first and second rotary encoders 30 and 31. In the haptic feedback input device, an absolute position detecting unit is composed of the first and second swing arms 9 and 10 respectively fixed to the first and second driving levers 5 and 6 and the photo interrupters 32 and 33 that detect the existence of the blocking portions 9*a* and 10*a* formed at the swing arms 9 and 10 and that output ON/OFF signals, and the control unit 34 calculates the reference position of the operating lever 7, based on the ON/OFF switching signals of the photo interrupters 32 and 33. Therefore, an absolute position detecting unit having a simple structure can be realized by combining the swing arms 9 and 10 with the photo interrupters 32 and 33, and the durability and detection accuracy of the haptic feedback input device can be improved.

In addition, the photo interrupters 32 and 33 output ON/OFF switching signals when the first and second driving levers 5 and 6 are located at the center of the detection area in which the first and second driving levers 5 and 6 can swing, and thus the first and second swing arms 9 and 10 fixed to the driving levers 5 and 6 pass through the central position of the swinging range. Therefore, the operating lever 7 can automatically return to the neutral position irrespective of the previous state of the operating lever when the system is started, and a joystick type haptic feedback input device having high operability can be realized.

Figure 9:
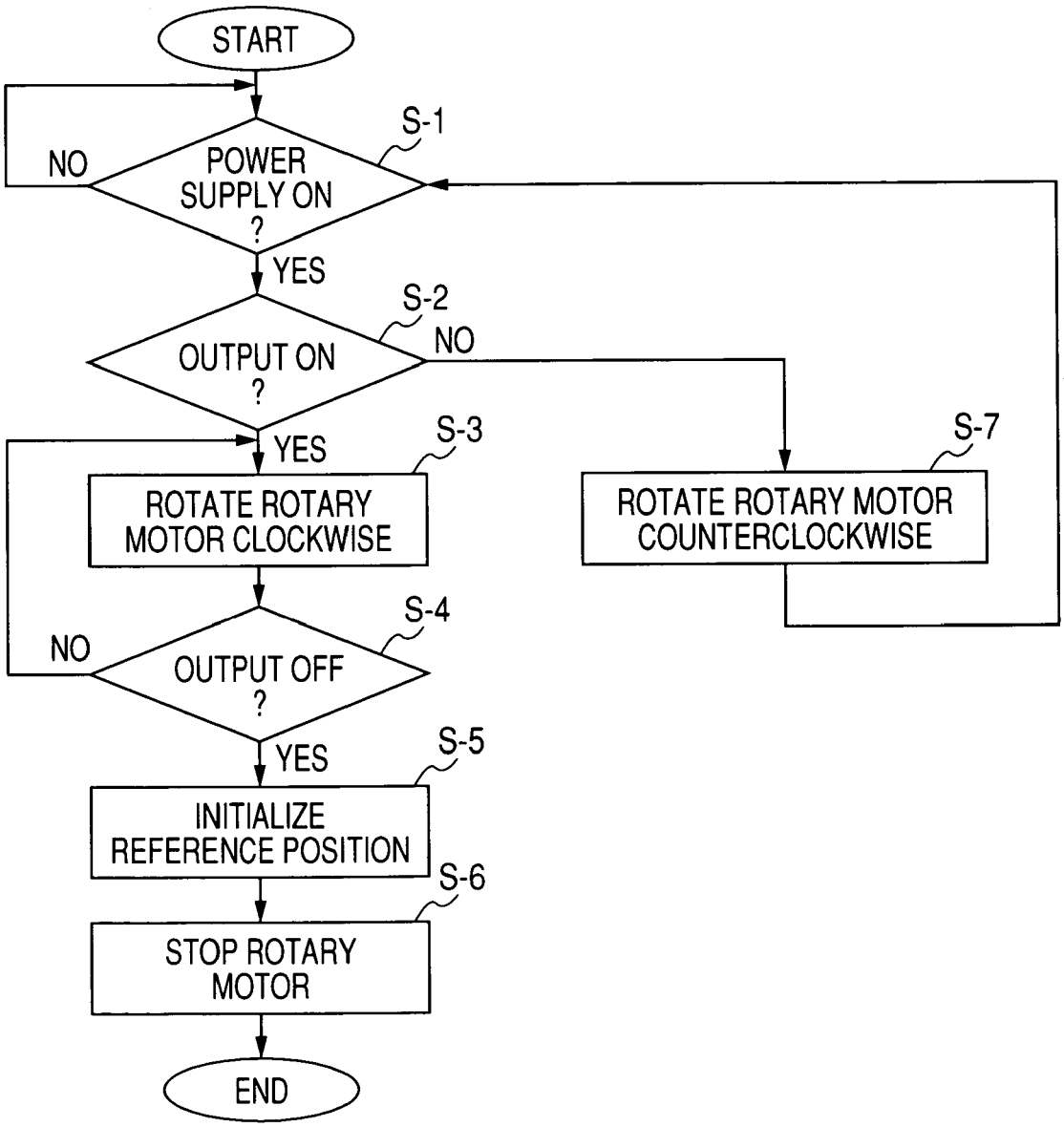
FIG. 9 is a flow chart illustrating a modification of the initializing operation sequence.
Figure 10:
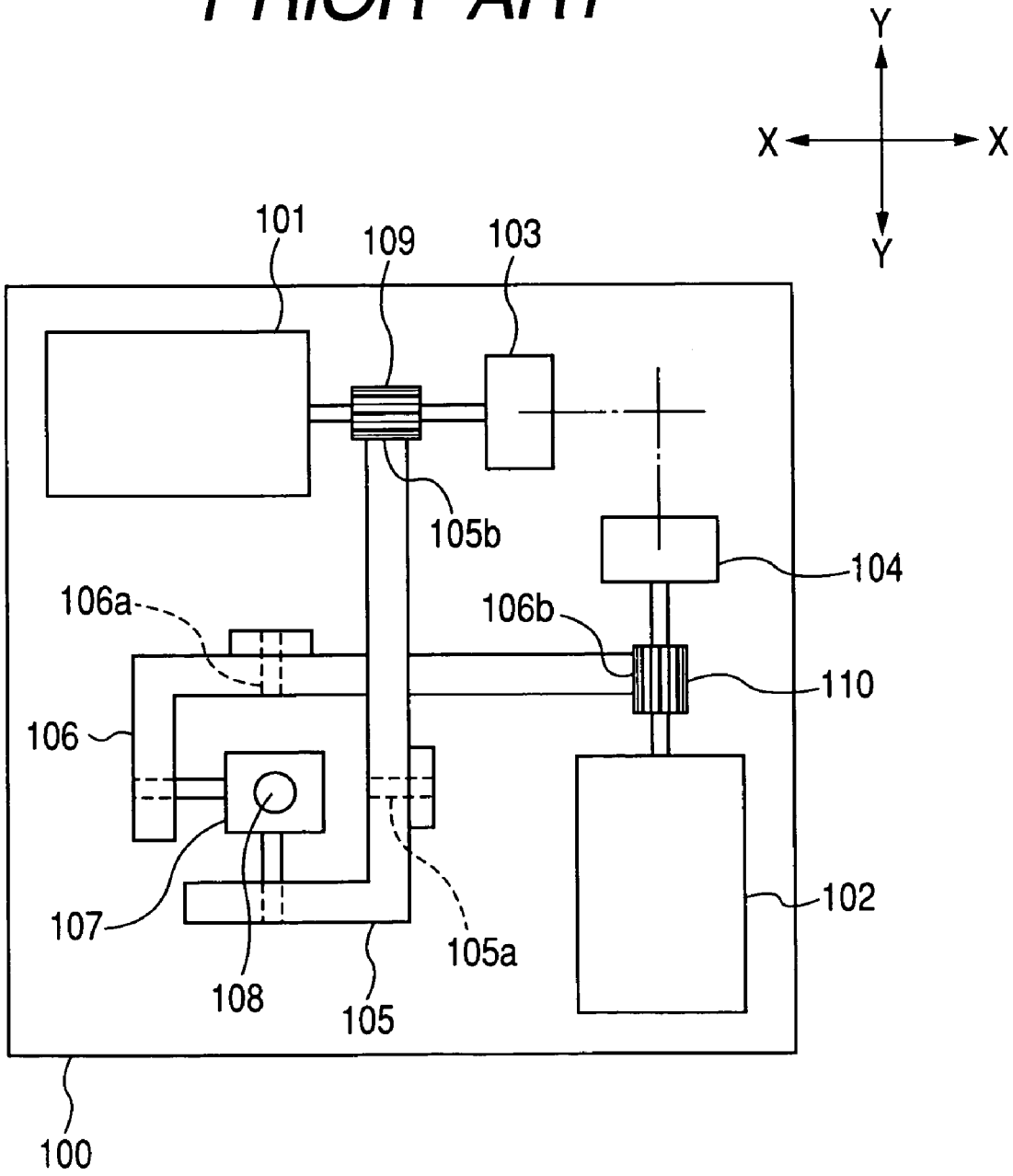
FIG. 10 PRIOR ART
FIG. 10 is a plan view illustrating the internal structure of a haptic feedback input device in the related art.

FIG. 9 is a flow chart illustrating a modification of the initializing operation sequence. The modification is different from the flow chart shown in FIG. 8 in that, when the control unit determines the output signals of the photo interrupters 32 and 33 in step (S-2), the first and second rotary motors 11 and 12 keep rotating counterclockwise until the output signals are switched to an ON state, and the other processes are basically the same as those in the flow chart shown in FIG. 8.

That is, as shown in FIG. 9, when the system of the haptic feedback input device is operated by turning the power supply on (S-1), first, the control unit 34 determines the type of signals outputted from the photo interrupters 32 and 33 of the first and second absolute position detecting units (S-2). Then, in step (S-2), if the output signals from the photo interrupters 32 and 33 are in an OFF state, the process proceeds to step (S-7), and then the control unit 34 rotates the first and second rotary motors 11 and 12 counterclockwise and maintains this state until the outputs of the photo interrupters 32 and 33 are switched to an ON state. In addition, in step (S-2), if the output signals from the photo interrupters 32 and 33 are in the ON state, the process proceeds to step (S-6) through steps from (S-3) to (S-5), similar to the process shown in FIG. 8. Then, the control unit 34 initializes the reference position and stops the first and second rotary engines 11 and 12.

As described above, in a haptic feedback input device according to an aspect of the invention, an absolute position detecting unit is composed of detection targets that move in conjunction with the movement of an operating member and detecting elements that detect the existence of the detection targets and that output ON/OFF signals, and a control unit computes the reference position of the operating member based on the change in the output of the detection element. Therefore, the moving amount of the operating member can be computed by an absolute position detecting unit having a simple structure, and the durability and detection accuracy of the absolute position detecting unit can be improved.

The invention claimed is:

1. A haptic feedback input device comprising:

an operating member that is manually operated by an operator;

a base that supports the operating member free to move;

a relative position detecting unit that detects the moving amount of the operating member;

an absolute position detecting unit that detects a reference position of the operating member;

actuators that apply feedback force to the operating member; and a control unit that controls the actuators based on output signals from the relative position detecting unit and the absolute position detecting unit, wherein the absolute position detecting unit is composed of swing arms that move in conjunction with the operating member and detecting elements that detect the existence of the swing arms, respectively, and that output ON/OFF signals, and the control unit computes the reference position of the operating member based on the change of the output of the detection element wherein blocking portions protruding outwards as much as half of a swing angle of the swing arms are formed on the swing arms.

2. The haptic feedback input device according to claim 1, wherein each of the swing arms occupies one side of a detecting area in which the respective swing arm moves, and the control unit controls the actuator to be rotated clockwise or counterclockwise until the change of output occurs in the detecting element when a system is started.

3. The haptic feedback input device according to claim 2, wherein the control unit controls the actuator to be driven in a direction where the respective swing arm is not detected when the detecting element detects the respective swing arm at the time when the system is started, and the control unit controls the actuator to be driven in a direction where the respective swing arm is detected when the detecting element does not detect the respective swing arm.

4. The haptic feedback input device according to claim 2, wherein the control unit stops driving the actuator when the respective swing arm reaches a location where the change of output occurs in the detecting element, and initializes the location as the reference position of the operating member.

5. The haptic feedback input device according to claim 1, wherein the operating member includes an operating lever free to move and a pair of driving levers swinging in accordance with the movement of the operating lever such that rotary shafts thereof are perpendicular to each other, and the actuators are a pair of rotary motors that apply feedback force to the operating member via the two driving levers.

6. The haptic feedback input device according to claim 5, wherein the detecting elements are photo interrupters provided in the swinging ranges of the swing arms, respectively, and the relative position detecting unit is a rotary encoder.

7. The haptic feedback input device according to claim 6, wherein each photo interrupter outputs ON/OFF switching signals when a respective swing arm passes a central location of the swinging range.

* * * * *

UNITED STATES PATENT AND TRADEMARK OFFICE

CERTIFICATE OF CORRECTION

PATENT NO. : 7,490,530 B2
APPLICATION NO. : 11/127726
DATED : February 17, 2009
INVENTOR(S) : Ishikawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 902 days.

Signed and Sealed this
Twenty-ninth Day of March, 2011

David J. Kappos

David J. Kappos
*Director of the United States Patent and Trademark Office*